US005799605A

United States Patent [19]

Huse

[11] Patent Number: 5,799,605

[45] Date of Patent: Sep. 1, 1998

[54] EXPANDABLE BOAT SEAT

[75] Inventor: O. C. Huse, Arlington, Tex.

[73] Assignee: Moeller Marine Products, Goodlettsville, Tenn.

[21] Appl. No.: 704,370

[22] Filed: Aug. 28, 1996

Related U.S. Application Data

[60] Provisional application No. 60/002,839, Aug. 28, 1995.

[51] Int. Cl.[6] ..... B63B 17/00

[52] U.S. Cl. ..... 114/363

[58] Field of Search ..... 114/363, 343; 297/188.01, 188.08, 217.1, 188.09

[56] References Cited

U.S. PATENT DOCUMENTS

| | | | |
|---|---|---|---|
| 3,379,471 | 4/1968 | Dalziel | 114/363 |
| 3,394,417 | 7/1968 | O'Link | 114/363 |
| 3,473,176 | 10/1969 | Taylor | 114/363 |
| 3,570,029 | 3/1971 | Hunsaker | 114/363 |
| 4,854,261 | 8/1989 | Goldsmith | 114/363 |

*Primary Examiner*—Stephen Avila
*Attorney, Agent, or Firm*—Howard & Howard

[57] ABSTRACT

The present invention discloses an expandable seat and storage unit particularly adapted for use in a boat. The expandable seat has a base unit which defines a storage area. A frame is slidably mounted within the base and can slide with respect to the base to expand the length of the seat to form a bed. The frame is locked into the base by the back cushion of the seat. By removing the back cushion, the frame section can be slid out of the base and then the back cushion can be used along with the seat cushion to form a bed. The frame has side members which extend generally perpendicular from the side edges of the front face of the frame and ride in tracks formed in the base unit. The tracks are along the sides of the base unit and do not interfere with the storage area. Further, the tracks are formed integrally in the base unit to facilitate easy inexpensive manufacture and operation.

20 Claims, 4 Drawing Sheets

EXPANDABLE BOAT SEAT

BACKGROUND

This application claims priority to United States Provisional application Ser. No. 60/002,839 filed Aug. 28, 1995 in the name of O. C. Huse.

The present invention relates to an expandable seat and storage unit. More particularly, the present invention relates to an expandable seat and storage unit for use in a marine vehicle such as, for example, a pontoon boat. The expandable seat of the present invention can be expanded to form a bed without disturbing the storage area within the unit. The seat has a self-contained sliding frame that slides into and out of the base unit. Cushions can be supported by the base unit and the sliding frame to form a bed. The unit also has a unique locking system for locking the sliding frame within the base.

Convertible boat seats are known. Typically, these seats have a metal framework that supports a bed mattress. The metal framework is collapsed when not in use and stored within the seat. The storage area is generally sized to house the metal frame and nothing else. Although arguably the seat could be considered to have a storage area, the only item that can be stored in it is the metal framework. Therefore, it doesn't provide additional storage space.

There are problems with this type of convertible seat. One problem is the lack of additional storage. Again, the frame takes up all available storage space within the seat unit. Another problem is the difficulty encountered in assembling the bed. The metal frame is cumbersome to remove from the seat unit and cumbersome to set up. The frame has to be expanded and secured to form the bed support. A bed or cushions are then placed on the frame. Alternatively, in some units, a sheet of material, such as canvas is pulled across the top of the frame and cushions or a mattress are placed on top of the sheet.

A still further problem with this type of convertible seat results from normal wear of the frame. As the frame wears, the frame begins to wobble resulting in at least an insecure feeling to the user, or, worse, an unsafe bed. It should be remembered that these units are used in boats which rock to and fro upon the waves. Therefore, the effect of loose connecting joints within the frame can be greatly amplified to the user. The metal frame also is prone to annoying squeaks when it is being used due to the movement of the metal frame against itself. Still further, when compared to the present invention, the metal frame beds are considerably more expensive to manufacture.

BRIEF SUMMARY OF THE INVENTION

The present invention overcomes the above problems by providing an expandable boat seat which has a storage unit that provides additional storage space; is easily expanded to a bed; is sturdy; is quiet and is inexpensive to manufacture where compared to other units.

Generally, the expandable boat seat of the present invention has a base unit which defines the base of the seat and a storage area. The top of the base unit has an opening so that items to be stored can be inserted into the storage area.

The front of the base is actually the face of a sliding frame for expanding the seat into, for example, a bed. The sliding frame is normally locked within the base unit by the back cushion of the seat. In order to expand the seat into a bed, the back cushion is removed from the base unit to allow the frame to be slid out of the base unit and then the back cushion serves as part of the bed mattress with the seat cushion serving as the rest of the matress.

In the preferred embodiment, the frame has a front face and two side members which are perpendicular to and extend from the front face. These side members are received within tracks formed in the base unit so that the front face can be slid out from the base unit to expand the seat. When slid into the base unit, the front face serves as the front of the seat. When slid out of the base unit, the front face serves as the foot of the bed. In the preferred embodiment, there are recessed areas which form handgrips to facilitate the sliding action of the support with respect to the base unit.

The side members of the frame include pockets which act as locking members for locking the frame within the base unit. As should be appreciated, it is important to lock the frame within the base member to prevent the frame from inadvertently sliding out of the base as the boat rocks. To lock the frame, the top of the base unit has an aperture which receives the bottom portion of the back cushion so that the back cushion can fit within the pockets of the frame. In the preferred embodiment, the aperture extends across the width of the top. The back cushion is preferably recessed to form a locking portion which easily slides through the aperture and into the pockets when the frame is slid into the base unit. In this way, with the frame slid into the base unit, the back cushion is dropped through the aperture into the pockets to lock the frame into the base unit. In order to slide the frame from the base unit, the back cushion is removed from the base unit to disengage the pockets and allow sliding of the frame with respect to the base unit.

To facilitate expansion of the seat into a bed, in the preferred embodiment the seat cushion of the seat is attached to the face of the frame. In this way, when the frame is slid out of the base unit, the seat cushion slides along with the frame and forms the bottom half of the mattress. The back cushion, which has been removed to allow the frame to slide with respect to the base, then forms the top portion of the mattress. Further, in the preferred embodiment, the seat cushion of the seat is hinged to the face so that it forms a pivotal top. By pivoting the seat cushion with respect to the base unit, the storage space within the base unit can be accessed.

In order to provide a more secure back support to the seat, and to provide a headboard for the expanded bed, a back support is provided in the preferred embodiment. The back support is attached to the base unit. In the preferred embodiment, the base unit has a recessed portion which is shaped like a mortise joint and the back support has a protrusion shaped like a tenon. By inserting the tenon into the mortise, and tightening the back support with respect to the base unit through a bolt or similar threaded member, a very tight interconnection is obtained. In this way, the back support is solidly connected to the base unit.

Tracks are formed in the base unit to facilitate sliding of the frame with respect to the base. In the preferred embodiment, the tracks are formed by recessing the center area of the top of the base unit so that tracks are formed adjacent the side walls of the base unit. Preferably, the storage area opening, the back cushion aperture and the mortise groove are all recessed to form a groove along both edges of the top of the base unit to define the track for each of the side members of the frame. Additionally, the bottom of the base unit can be raised to add additional tracks along the bottom edge of the base unit to further guide the side walls of the frame.

DETAILED DESCRIPTION OF THE INVENTION

Figure 1:
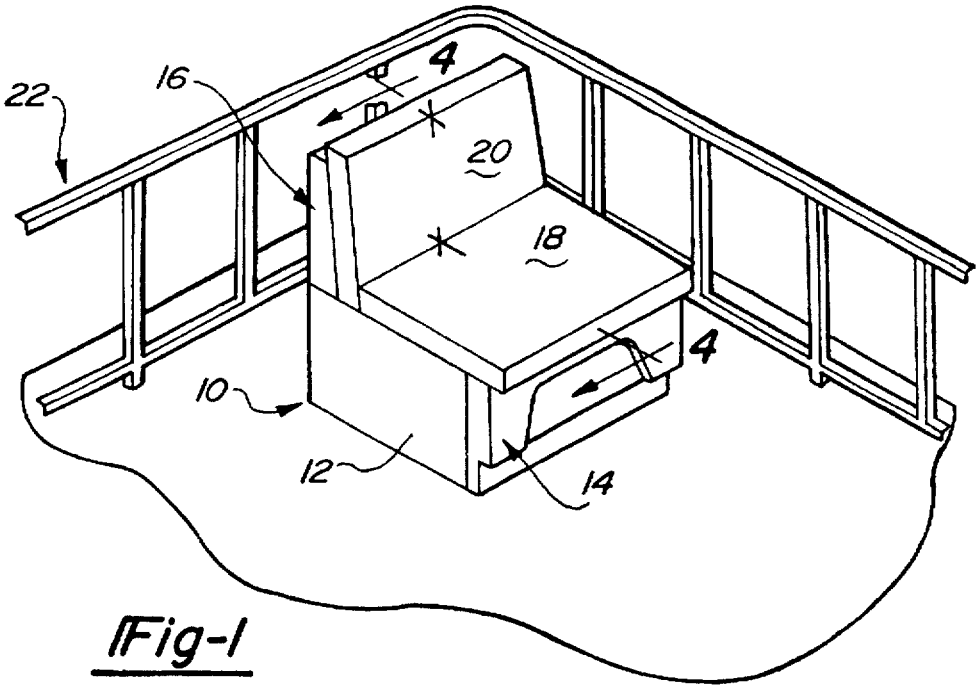
FIG. 1 is a perspective view of the seat of the present invention mounted within a pontoon boat.

With reference to FIG. 1, the expandable seat and storage unit of the present invention is shown generally at 10. The seat 10 includes a base unit 12, a sliding frame 14, a back support 16, and seat and back cushions 18 and 20 respectively. In the preferred embodiment, the expandable seat 10 is for use in a boat and is shown in FIG. 1 mounted within a pontoon-type boat shown generally at 22.

Figure 2:
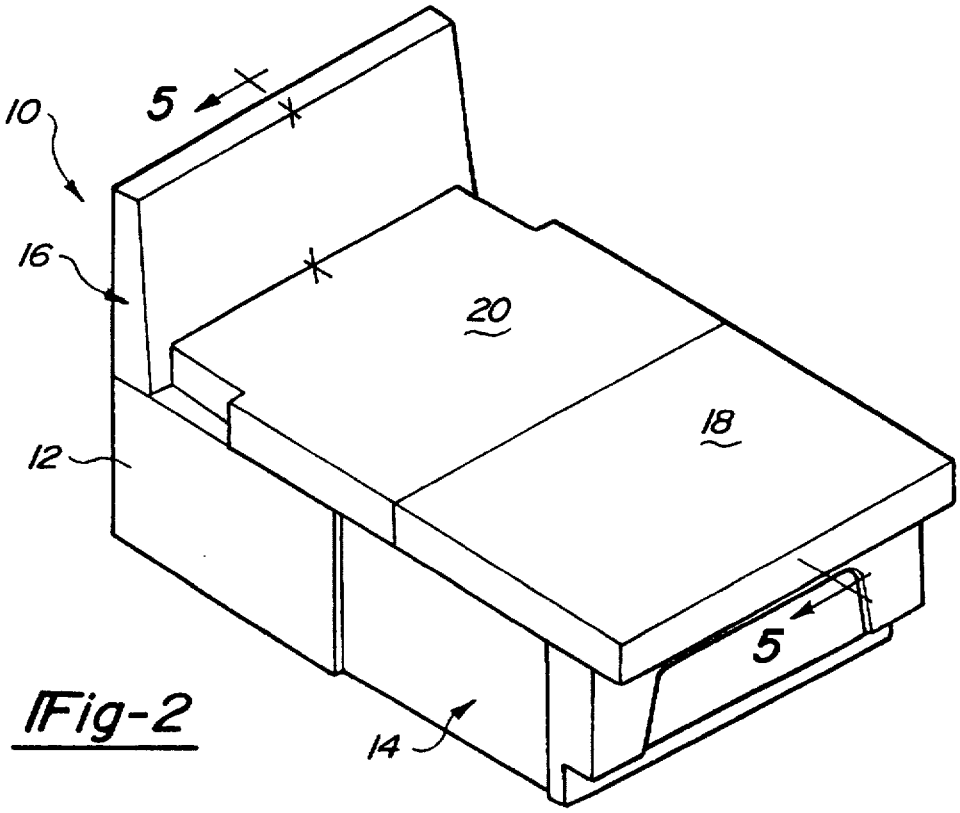
FIG. 2 is a perspective view of the seat of the present invention expanded to form a bed.

The expandable seat 10 is shown in FIG. 1 as a seat. The seat can be expanded into a bed as shown in FIG. 2. In the embodiment shown in FIG. 2, the sliding frame 14 is slid out of the base unit 12 with the seat cushion 18 forming the foot or bottom portion of the bed mattress. The back cushion 20 has been removed from this seat unit and laid down on top of the base unit to form the head or top portion of the mattress.

Figure 3:
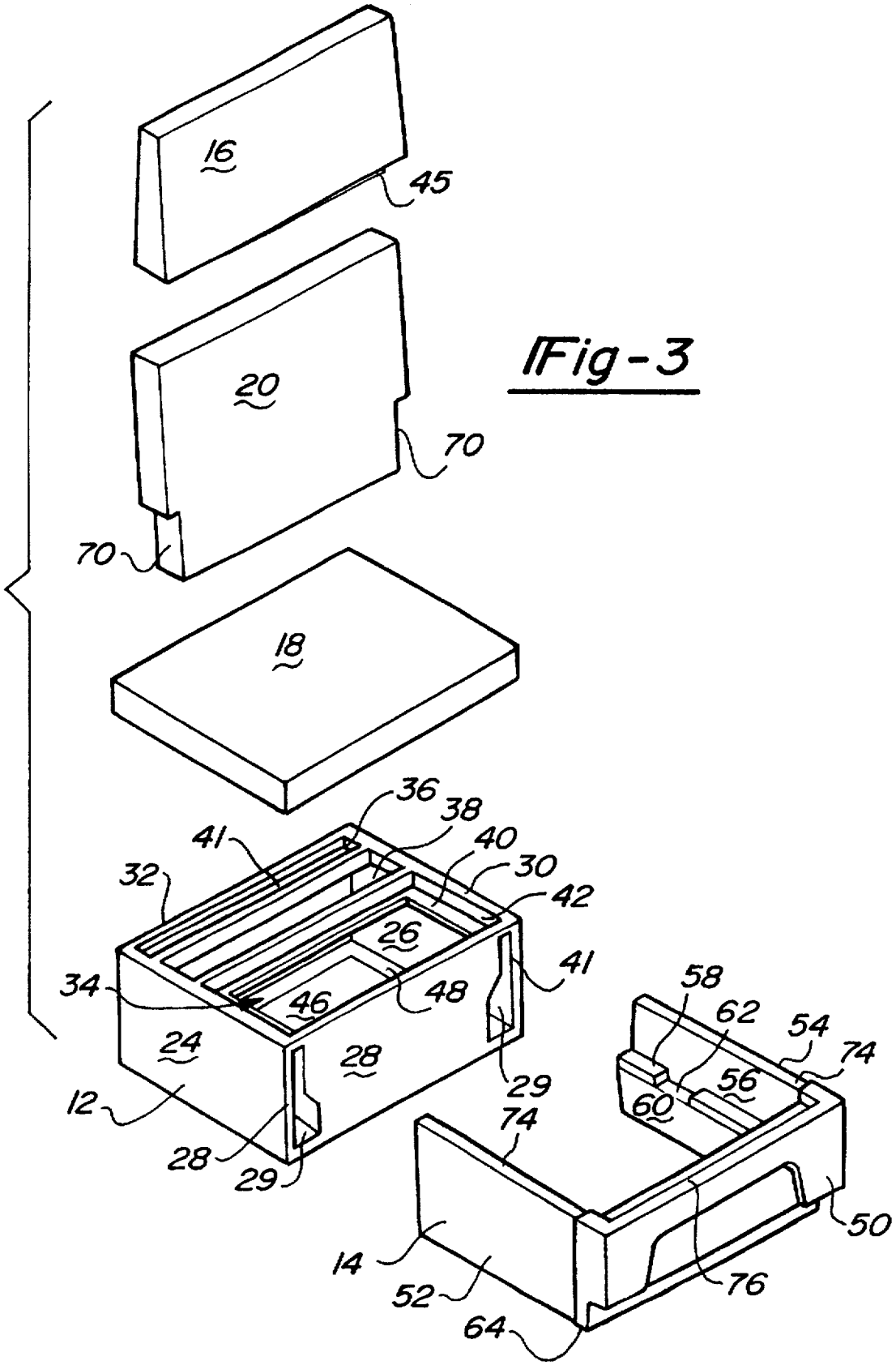
FIG. 3 is an exploded perspective view of the expandable seat and storage unit of the present invention.

With reference to FIG. 3, the base unit 12 is illustrated as a generally rectangular housing having opposed sides 24 and 26, a front 28 with openings 29, a top 30, a back 32 and a bottom 34. As will be appreciated by one of ordinary skill in the art, the back 32 and bottom 34 are optional and would not be necessary for the invention to function properly.

Figure 4:
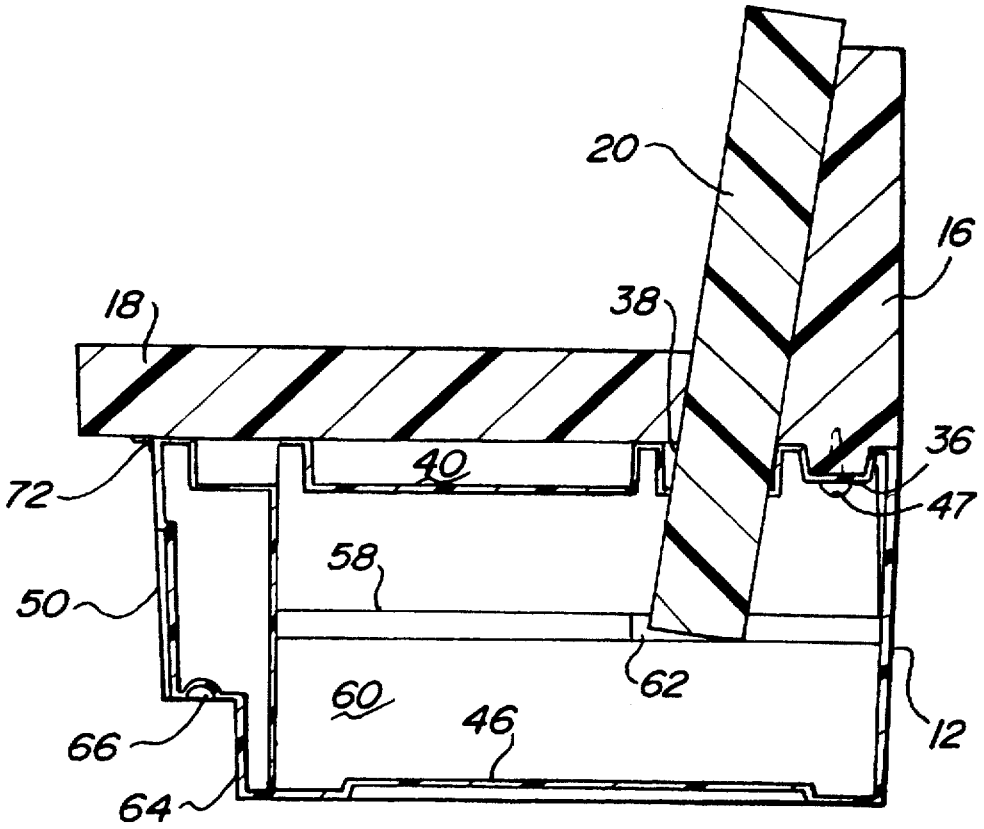
FIG. 4 is a cross-sectional view taken along line 4—4 of FIG. 1.
Figure 5:
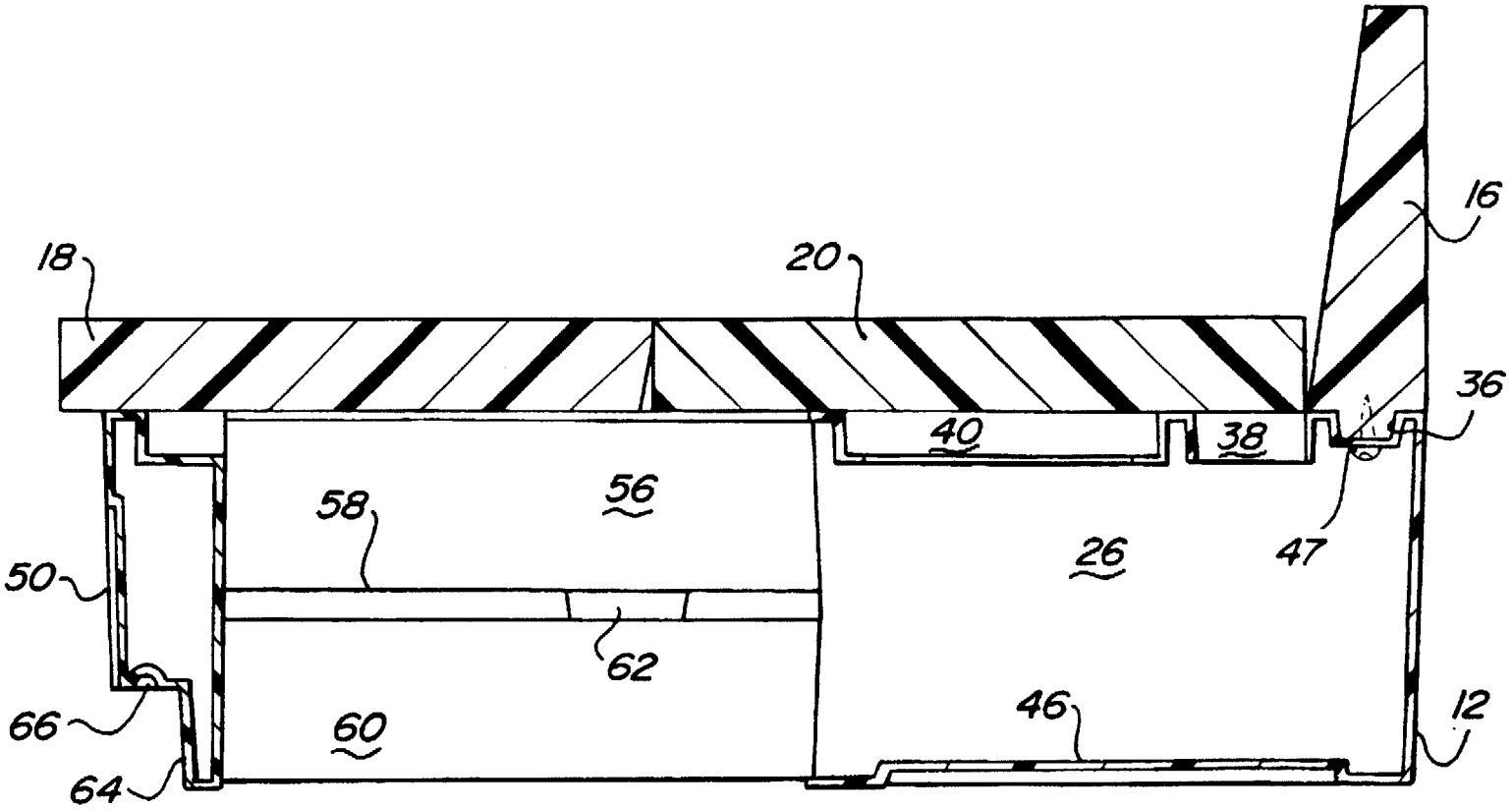
FIG. 5 is a cross-sectional view taken along line 5—5 of FIG. 2.

The top 30 of the base unit 12 has three recessed portions 36, 38 and 40. These recessed portions extend across substantially the entire width of the top 30 of base unit 12, but are spaced generally equidistantly from side walls 24 and 26 to define tracks 41 for guiding the frame 14 with respect to the base 12. The recessed portion 40 has an open bottom to provide access to the interior of the base unit which serves as the storage area. The recessed portion 38 is also open to provide a slot for receipt of the back cushion 20 which will be described in greater detail below. The recessed portion 36 has a closed bottom 44 for receipt of a protrusion 45 on the back support 16. In the preferred embodiment the sides of the protrusion 45 are angled to form a tenon and the sides of the recessed portion 36 are angled to form a mortise. This ensures a tight fit between the protrusion 45 and recessed portion 36 as protrusion 45 is drawn into recess 36. With reference to FIGS. 4 and 5, a fastener 47 is illustrated extending through the bottom 44 of recess 36 into the protrusion 45 to draw protrusion 45 into recess 36 and to securely attach the back support 16 to the base unit 12.

Also illustrated in FIG. 3 is a platform 46 formed in the bottom 34 of base unit 12. This platform is molded into the bottom 34 and extends substantially across its width; however, it does not extend fully across the width. Again, as with the recessed portions 36, 38 and 40 the opposed edges of the platform 46 are spaced from side walls 24 and 26 to form tracks 48. Tracks 48 receive the frame 14 to further guide the frame 14 within the base unit 12.

The frame 14 has a face member or plate 50 and sides 52 and 54 extending generally perpendicular from the face 50. The inner wall of each side 52 and 54 is contoured to form an upper wall 56, ledge 58 and downwardly inclined lower wall 60. A locking pocket 62 is formed in the ledge 58 and is adapted to receive the back cushion 20 to lock the frame 14 in base unit 12 when the expandable seat is in the position shown in FIG. 1. This will be discussed in greater detail below.

To facilitate sliding of the frame 14 out of base 12, the front face 50 is recessed at 64 and has a gripping portion 66. To expand the seat, a user grips the gripping portion 66 and pulls the front face 50 away from the base unit 12 to expand the seat. The sides 52 and 54 are partially pulled out of openings 29. Alternatively, the same procedure can be used to slide the frame 14 back into the base unit to contract the bed to form the seat shown in FIG. 1.

The back cushion 20 is preferably recessed at 70 for insertion into the aperture 38 in the top 30. The recessed portion 70 is sufficiently long to protrude through aperture 38 and into pocket 62 when frame 14 is slid into base unit 12. With the back cushion 20 inserted into pocket 62, the frame 14 is locked within base unit 12. In order to slide frame 14 out of base unit 12, the back cushion 20 must be removed from pocket 62 and preferably aperture 38.

In the preferred embodiment, cushion 18 is secured to the front face 50 by a hinge 72 so that when frame 14 is slid with respect to base unit 12, cushion 18 slides with the frame 14. Additionally, the hinge permits the seat cushion 18 to be pivoted with respect to the base unit 12 when the seat is in the position shown in FIG. 1 so that the storage area can be easily accessed.

In use, the expandable seat illustrated at 10 in FIG. 1 can be expanded into a bed as shown in FIG. 2 by first removing back cushion 20. With back cushion 20 removed, the frame 14 can be slid with respect to base unit 12 to the position shown in FIG. 2. In the preferred embodiment, cushion 18 slides with sliding support 14 and is supported by the top edges 74 of the sides 52 and 54 and the top edge 76 of face 50. The back cushion can then be placed on base unit 12 and top edges 74 of sides 52 and 54 to complete the mattress of the bed. This is shown in FIG. 2 and in cross-section in FIG. 5. To return the bed to the seat shown in FIG. 1 and in cross-section in FIG. 4, the cushion 20 is removed from the bed and frame 14 is slid back into base unit 12. The back cushion 20 is then inserted into aperture 38 for receipt in pocket 62 to lock frame 14 into base unit 12. Access to the storage unit defined by base unit 12 can be obtained either by sliding support 14 out of base unit 12 or by pivoting seat cushion 18 about hinge 72, which exposes recessed opening 40 which opens into the storage area defined by base unit 12.

In the preferred embodiment, the base unit 12, back support 16 and frame 14 are all formed from plastic, preferably PVC plastic. These members are preferably made by rota-molding but could be vacuum formed, injection molded or formed in any other known manner of forming plastic.

Preferably, the base 12 and frame 14 are mated together while they are still hot and allowed to cool together. This reduces distortion between these parts to insure better operation of the seat 10. The seat cushions 18 and 20 are formed with a rigid back, and have foam on top of the back and then upholstery over the foam. The rigid backs provide further support for the cushions when used either in the seat as shown in FIG. 1 or the mattress as shown in FIG. 2.

As should be appreciated by those of ordinary skill in the art, the above is a description of the preferred embodiment of the invention, but it's not to be read in a limiting way. The invention is only intended to be limited by the appended claims. By way of illustration, the preferred embodiment could be modified by fixing face plate 50 to the base unit 12 and having the sides 52 and 54 slide within elongated apertures in face 50. In this way, the seat 18 would be fixed to the front edges of the sides 52 and 54 and would slide as a unit with sides 52 and 54. The face itself would remain fixed to the base unit 12. Additionally, as stated previously, the base unit 12 could be modified by removing the back 32 and base 34 without substantially adversely affecting the operation of the expandable seat. Those of ordinary skill in the art will appreciate other variations which could be made to the present invention and still be within the scope of the claims.

What is claimed is:

1. An expandable seat and storage unit comprising:

a base and a removable back cushion;

said base defining a storage area which can be opened;

a frame member slidably mounted within said base;

said frame member being slidable with respect to said base to expand the length of said base;

a locking means for locking said frame member within said base, said locking means being operatively engaged by said removable back cushion to lock and unlock said frame member.

2. The expandable seat and storage unit of claim 1, including a back support and mounting means for mounting said back support to said base, said back support being adapted to support said removable back cushion.

3. The expandable seat and storage unit of claim 2, wherein said mounting means includes at least one groove formed in said base and a protrusion protruding from said back support adapted to fit within said groove and to be secured within said groove to said base unit.

4. The expandable seat and storage unit of claim 1, wherein said base has an opening in said top for access to said storage area.

5. The expandable seat and storage unit of claim 4, further including a seat cushion mounted upon said top of said base unit, said seat cushion being adapted to selectively close said opening to said storage area.

6. The expandable seat and storage unit of claim 1, wherein said base has an aperture for receipt of a portion of said removable back cushion;

said frame member having at least one pocket for receipt of said portion of said removable back cushion;

whereby said frame is locked within said base unit when said portion of said removable back cushion is in said aperture and said pocket.

7. The expandable seat and storage unit of claim 1, further including a seat cushion having at least one edge mounted to said frame such that said seat cushion and said frame move with respect to said base when said frame is slid out of said base to expand said expandable seat.

8. The expandable seat and storage unit of claim 1, wherein said removable back cushion is sized to fit upon said base when said expandable seat is expanded.

9. The expandable seat and storage unit of claim 1, wherein said frame has a front face and sides, said sides being generally at right angles to said front face, said sides being adapted to slide within said base.

10. The expandable seat and storage unit of claim 9, wherein said support has a seat cushion attached to said front face and extending outwardly over said base when said front face is slid against said base, said cushion being supported by said sides when said frame is slid out of said base.

11. The expandable seat and storage unit of claim 1, wherein said base is contoured to define at least one track for guiding said frame with respect to said base.

12. The expandable seat and storage unit of claim 11, wherein said frame has side members and said base has a top and sides, said base sides being adjacent and generally parallel to said frame sides;

said track being formed in said top and having elongated channels formed adjacent said base sides extending generally parallel to said base sides, said channels being shaped to mate with said frame sides to guide said frame sides within said base.

13. The expandable seat and storage unit of claim 12, wherein said channels are integrally formed in said top.

14. The expandable seat and storage unit of claim 12, wherein said base has a bottom, said bottom having elongated channels strapped to mate with said frame sides to guide said frame sides within said base.

15. An expandable seat and storage unit, comprising:

a base having opposing sides, a top and a sitting area, said sitting area being adapted to be sat upon and a storage area generally defined by said opposed sides, and said top;

a frame having edges for supporting said sitting area mounted within said base, said frame being adapted to slide out of said base to expand the length of said base to increase the surface area of said sitting area;

said frame being slidable with respect to said base without interfering with said storage area.

16. The expandable seat and storage unit of claim 15, further including a removable back cushion;

said base having an aperture for receipt of a portion of said removable back cushion;

said frame having at least one pocket for receipt of said portion of said removable back cushion;

whereby said frame can be locked with said base unit when said portion of said removable back cushion in said aperture and said pocket.

17. The expandable seat and storage unit of claim 15, wherein said base is contoured to define at least one track for guiding said frame with respect to said base.

18. The expandable seat and storage unit of claim 17, wherein said frame has side members and said base has a top and sides, said base sides being adjacent and generally parallel to said frame sides;

said track being formed in said top and having elongated channels from adjacent said base sides extending generally parallel to said base sides, said channels being shaped to mate with said frame sides to guide said frame sides within said base.

19. The expand able seat and storage unit of claim 18, wherein said channels are integrally formed in said top.

20. The expandable seat and storage unit of claim 17, wherein said base has a bottom, said bottom having elongated channels shaped to mate with said frame sides to facilitate guidance of said frame sides within said base.

* * * * *